US007771330B2

(12) United States Patent
Towley, III et al.

(10) Patent No.: US 7,771,330 B2
(45) Date of Patent: Aug. 10, 2010

(54) SELECTORIZED DUMBBELL HAVING SHOCK ABSORBING SYSTEM

(75) Inventors: Carl K. Towley, III, Alexandria, MN (US); Gregory S. Olson, Owatonna, MN (US)

(73) Assignee: Power Block Holdings, Inc., Owatonna, MN (US)

( * ) Notice: Subject to any disclaimer, the term of this patent is extended or adjusted under 35 U.S.C. 154(b) by 0 days.

(21) Appl. No.: 11/498,314

(22) Filed: Aug. 2, 2006

(65) Prior Publication Data

US 2008/0032873 A1 Feb. 7, 2008

(51) Int. Cl.
*A63B 21/072* (2006.01)
*A63B 21/08* (2006.01)
*A63B 21/06* (2006.01)

(52) U.S. Cl. ..... 482/108; 482/93; 482/97

(58) Field of Classification Search ..... 482/93, 482/94, 97, 98, 104, 106, 107, 108, 908, 482/910, 50
See application file for complete search history.

(56) References Cited

U.S. PATENT DOCUMENTS

| | | | | |
|---|---|---|---|---|
| 3,463,486 | A * | 8/1969 | James, Jr. | 482/106 |
| 3,815,903 | A * | 6/1974 | Blomqvist | 482/103 |
| 4,659,079 | A * | 4/1987 | Blanchard | 473/60 |
| 4,911,433 | A * | 3/1990 | Walker et al. | 482/105 |
| 4,974,837 | A * | 12/1990 | Someya et al. | 482/98 |
| 5,029,849 | A * | 7/1991 | Nurkowski | 482/106 |
| 5,443,435 | A * | 8/1995 | Wilkinson | 482/74 |
| 5,779,604 | A | 7/1998 | Towley, III et al. | |
| 5,788,608 | A * | 8/1998 | Wilkinson | 482/51 |
| 6,228,003 | B1 | 5/2001 | Hald et al. | |
| 6,261,022 | B1 | 7/2001 | Dalebout et al. | |
| 6,629,910 | B1 * | 10/2003 | Krull | 482/98 |
| 6,733,424 | B2 * | 5/2004 | Krull | 482/98 |
| 7,052,445 | B2 * | 5/2006 | Ekhaus | 482/93 |
| 7,128,696 | B1 | 10/2006 | Krull | |
| 7,172,536 | B2 | 2/2007 | Liu | |
| 7,238,147 | B2 | 7/2007 | Mills | |
| 2004/0162198 | A1 | 8/2004 | Towley et al. | |

FOREIGN PATENT DOCUMENTS

EP 1447115 A1 * 8/2004

* cited by examiner

*Primary Examiner*—Loan H Thanh
*Assistant Examiner*—Sundhara M Ganesan
(74) *Attorney, Agent, or Firm*—James W. Miller

(57) ABSTRACT

A selectorized dumbbell has a handle that can be inserted into a gap between stacks of nested left and right weight plates. A selector determines how many left weight plates are coupled to the left end of the handle and how many right weight plates are coupled to the right end of the handle. Each weight plate is held between a pair of flexible arms on a forked carrier. The arms allow the weight plates to deflect out of a normal, substantially upright, orientation if an impact shock is delivered to the dumbbell. The arms are restored to their normal orientation once the impact shock dissipates. This allows the impact shock to be absorbed without damaging the dumbbell or while minimizing damage to the dumbbell.

12 Claims, 4 Drawing Sheets

SELECTORIZED DUMBBELL HAVING SHOCK ABSORBING SYSTEM

TECHNICAL FIELD

This invention relates to a selectorized dumbbell having a selector that the user manipulates to adjust the mass of the dumbbell by coupling desired numbers of weight plates to opposite ends of a handle. More particularly, this invention relates to a selectorized dumbbell having a system for absorbing impact shocks on the dumbbell.

BACKGROUND OF THE INVENTION

A full set of traditional dumbbells has various pairs of dumbbells with different mass, e.g. a pair of 5 pound dumbbells, a pair of 10 pound dumbbells, and so on. Such dumbbells are used for weight training exercises such as biceps curls, triceps extensions, etc. Different users will use whatever size dumbbells are most suited to their particular physical condition and exercise needs. For example, one user might lift 10 pound dumbbells while another user might lift 50 pound dumbbells.

Such a dumbbell set is both costly to purchase and requires a fair amount of storage space. Storage racks are needed simply to store the various pairs of dumbbells. As a practical matter, individuals and small gyms or exercise clubs may not be able to afford either the money or the storage space required for a full set of traditional dumbbells.

Selectorized dumbbells overcome the cost and space obstacles presented by traditional dumbbells. In a selectorized dumbbell, a plurality of weights are nested together. The weights provide a stack of nested left weight plates and a stack of nested right weight plates. The left and right stacks of weight plates are separated from one another by a gap.

In a selectorized dumbbell, a handle is inserted into the gap between the left and right stacks of weight plates. A selector is then manipulated to determine how many of the left and right weight plates of the weights are coupled to the left and right ends of the handle. Once the selector is positioned to pick up a selected number of weights, the handle can then be lifted by the user from between the stacks of weight plates. The selected number of weights will rise with the handle to be used in performing various exercises with the dumbbell.

The obvious advantages of selectorized dumbbells are the cost and space savings provided to the purchaser. Only two dumbbells need be purchased and not an entire set. Yet, these two dumbbells can provide a wide range of exercise mass depending upon how many of the nested weights are coupled to the handle by the selector. Moreover, the only storage space required is that needed for two dumbbells and the nested weights that accompany them. All of this can be stored on a small rack that takes up only a few square feet of floor space. Thus, a single pair of selectorized dumbbells provides an economical alternative to a full set of traditional dumbbells.

The various weights of a selectorized dumbbell must nest inside one another in a smooth and reliable fashion. In addition, the selector coacts with portions of the weights so as to be able to pick up different numbers of weights when the selector is moved between different positions. This requires that the weights, selector and handle all remain aligned within fairly close tolerances. If these tolerances are not maintained, then the selector or the weights may jam and prevent use of the selectorized dumbbell.

While traditional dumbbells are fairly impervious to damage, this is not the case for the more complicated and sophisticated structure of selectorized dumbbells. The weights of a selectorized dumbbell are sometimes dropped onto a floor. This might happen with just a single weight that gets knocked off a rack. Or the user can accidentally drop an entire dumbbell loaded with one or more of the weights onto the floor. In any event, if this happens from higher than about two feet, the weights of the dumbbell can be bent or misaligned or various components of the selector can become bent, misaligned or damaged.

Many weights used in a selectorized dumbbell comprise a pair of spaced weight plates welded to a pair of rails. When these weights are bent, most people do not have the welding equipment and experience to repair them. Usually, the bent weights must be replaced. This is done either by the owner of the dumbbell at his or her own expense or by the manufacturer of the dumbbell as part of a warranty claim. Sometimes, the entire dumbbell might have to be replaced if the damage also extends to the selector or the handle.

In addition, other selectorized dumbbells use rigid plastic protrusions on the weights that coact with selectors having metallic or rigid plastic parts. It sometimes happens that the plastic protrusions on the weights or the plastic parts on the selectors break off. Sometimes, the metallic parts on the selectors bend. When this happens, it is generally impossible to repair the damaged parts, particularly when the damage occurs to the broken plastic weight protrusions or plastic selector parts.

Accordingly, it would be an advance in the exercise art to provide a selectorized dumbbell that can absorb impact shocks without significant damage being done.

SUMMARY OF THE INVENTION

One aspect of this invention relates to a selectorized dumbbell. The dumbbell comprises a combination including a plurality of nested weights, a handle, and a selector that couples a selected number of the weights to the handle. A shock absorbing system is placed somewhere in the combination of nested weights, handle, and selector.

Another aspect of this invention relates to a selectorized dumbbell of the type noted above. Each nested weight comprises at least one rigid weight plate. A weight frame has rigid and flexible portions. The weight frame carries the weight plate on the flexible portion thereof to permit movement of the weight plate relative to the rigid portion of the weight frame in response to an impact shock.

Yet another aspect of this invention relates to a selectorized dumbbell. The dumbbell comprises a stack of nested left weight plates separated by a gap from a stack of nested right weight plates. A handle is provided that can be inserted into the gap between the weight plate stacks. A selector is provided that determines how many left weight plates are coupled to a left end of the handle and how many right weight plates are coupled to a right end of the handle. Each weight plate is carried on at least one flexible member, wherein the members are configured to allow the weight plates to deflect out of a normal orientation if an impact shock is delivered to the dumbbell and to subsequently restore the weight plates to their normal orientation once the impact shock dissipates.

Still another aspect of this invention relates to a selectorized dumbbell of the type noted above. Each nested weight comprises a forked carrier having a pair of spaced arms. A weight plate is held between the arms of the carrier.

An additional aspect of this invention relates to a selectorized dumbbell of the type noted above. Each nested weight comprises a pair of weight plates. A weight frame carries the weight plates in a spaced apart orientation. The weight frame comprises a pair of carriers. Each carrier has a base and at least one arm projecting upwardly from the base with the weight plate being secured to the arm such that each carrier holds one weight plate. A pair of elongated interconnecting members extend between and releasably connect opposite front and back sides of the bases of the pair of carriers to join the carriers together and hold the carriers in the spaced apart orientation. Each interconnecting member has a substantially flat, planar cross-sectional profile. Each interconnecting member is secured to an angled portion of the carrier in a manner that causes the cross-sectional profile of the interconnecting member to angle outwardly away from the base of the carrier as the interconnecting member rises from a bottom edge to a top edge thereof.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
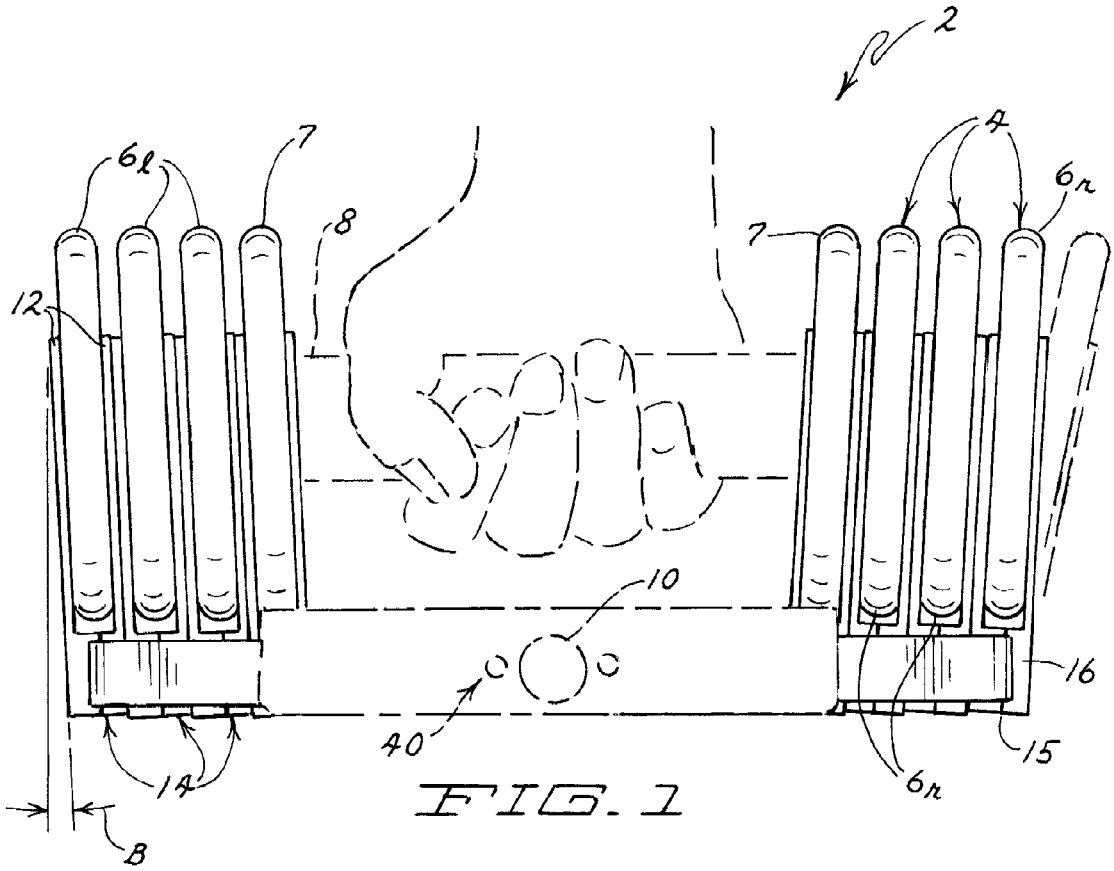
FIG. 1 is a front plan view of one embodiment of a selectorized dumbbell according to this invention.

One embodiment of a selectorized dumbbell according to this invention is illustrated generally as 2 in FIG. 1. Dumbbell 2 is similar to that shown in the Applicants' U.S. Pat. No. 5,769,762, which is hereby incorporated by reference. Dumbbell 2 is also similar to that shown in the Applicants' published U.S. patent application 2004/0162198, which is also hereby incorporated by reference. Only those features of dumbbell 2 which relate to this invention will be described in detail herein. The materials incorporated by reference above can supply other information regarding the general structure and operation of dumbbell 2 in the event the reader hereof desires or requires such information.

Figure 5:
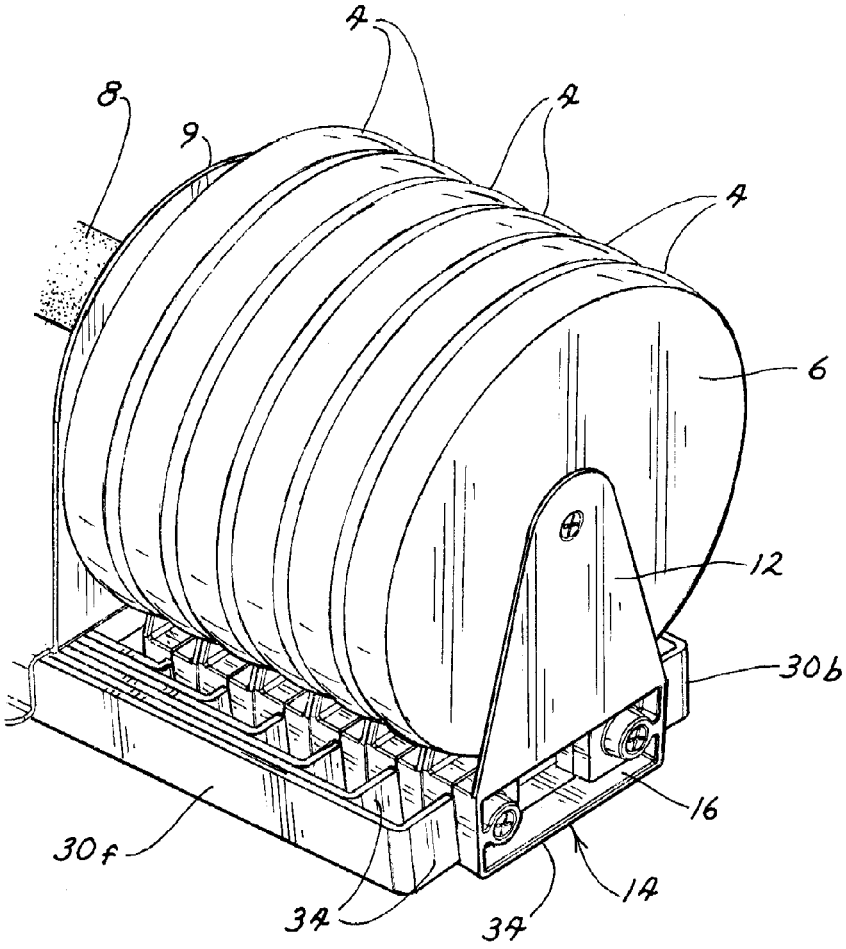
FIG. 5 is a perspective view of one end of a selectorized dumbbell like that of FIG. 1, particularly illustrating a stack of six nested left or right weight plates and how the weight plates and connecting rails in such stack nest together.

Dumbbell 2 is illustrated in FIG. 1 having three nested weights 4. Weights 4 provide a stack of nested left weight plates $\mathbf{6}_l$ and a stack of nested right weight plates $\mathbf{6}_r$. The number of nested weights 4 can obviously vary. For example, dumbbell 2 shown in FIG. 5 has six nested weights 4 that provide six weight plates 6 in each stack of the left or right weight plates $\mathbf{6}_l$ or $\mathbf{6}_r$. If desired, dumbbell handle 8 can also permanently carry a weight plate 7 at each end thereof as shown in FIG. 1. Alternatively, as shown in FIG. 5, each end of handle 8 could simply comprise a side flange 9 that is free of any handle carried weight plates.

Handle 8 is inserted into a gap between the two stacks of nested left and right weight plates $\mathbf{6}_l$ and $\mathbf{6}_r$. The position of a selector 10, such as a pin, determines how many nested weights 4 are coupled to handle 8. This is how a user varies the exercise mass of a selectorized dumbbell 2, namely by adjusting selector 10. Selector 10 can take many shapes, i.e. an insertable pin, a rotary dial, multiple rotary dials, etc.

One aspect of this invention involves the placement of a shock absorbing system somewhere in the combination of nested weights 4, handle 8, and selector 10 that comprise dumbbell 2. The preferred embodiment of this invention places the shock absorbing system in nested weights 4, but this invention is not limited to this specific placement. The shock absorbing system could be placed in handle 8 or in selector 10.

The term "shock absorbing system" as used in this application is defined to mean some type of structure that will deflect, deform or otherwise move from a normal orientation when a shock is applied to dumbbell 2, such as when dumbbell 2 is dropped and hits the floor, and that restores to the normal orientation after the shock has passed through dumbbell 2. This allows dumbbell 2 to absorb impact shocks thereby lessening the risk of damaging dumbbell 2.

Figure 3:
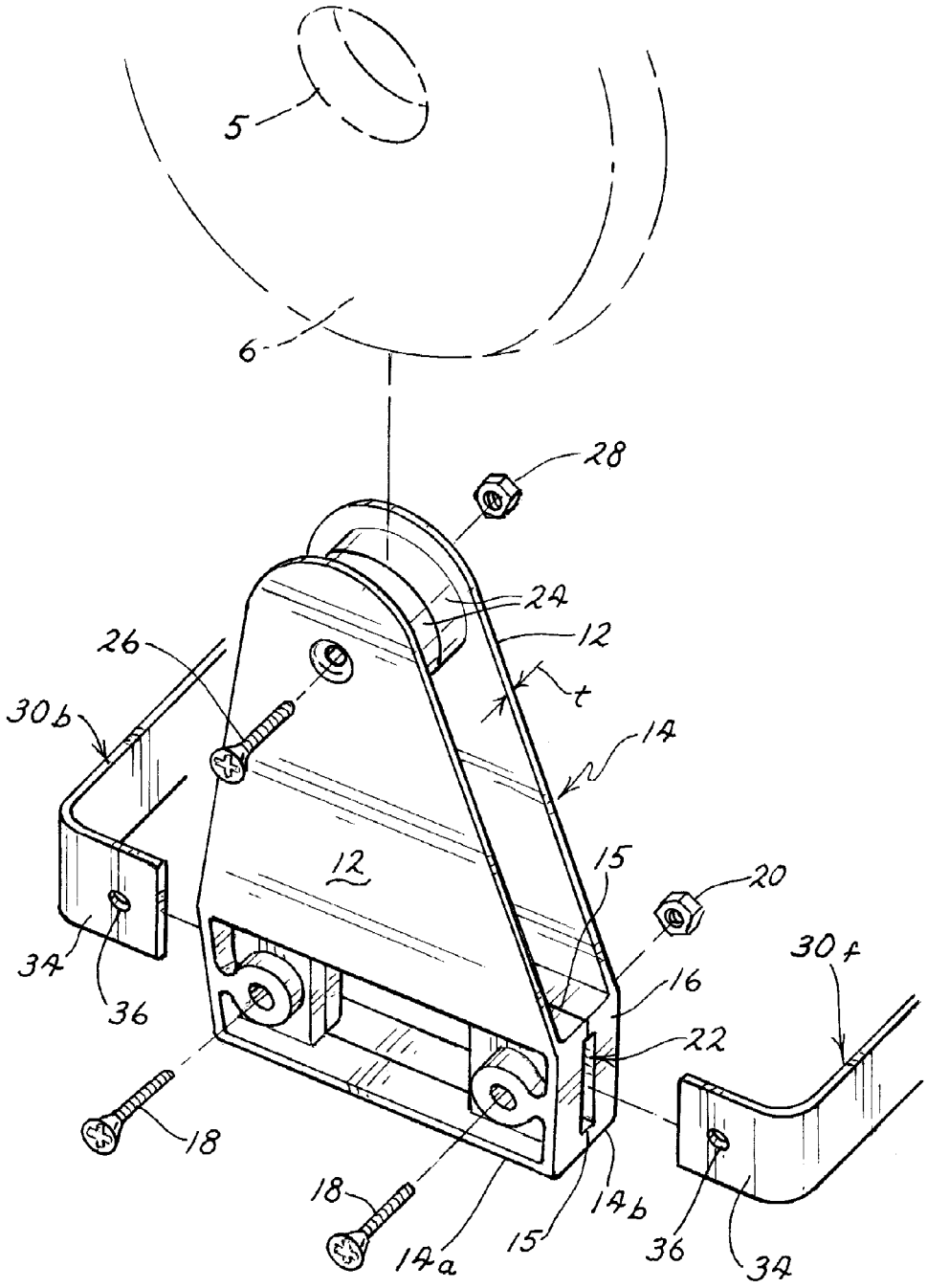
FIG. 3 is a perspective view of one end of one weight of the selectorized dumbbell of FIG. 1, particularly illustrating one of the weight plates of the weight along with the carrier that holds the weight plate to a pair of rails.

Each weight plate 6 in the various weights 4 is held between the arms 12 of a forked carrier 14. As shown in FIGS. 1 and 3, arms 12 extend upwardly from an underlying base 16 of carrier 14. Base 16 of carrier 14 is substantially rigid. Arms 12 taper inwardly as they rise from base 16 of carrier 14 to be generally triangular in shape. Arms 12 are substantially smaller than weight plate 6 carried between arms 12.

Arms 12 of carrier 14 are flexible. This permits arms 12 of carrier 14 and weight plate 6 carried thereby to have a normal, substantially upright orientation as shown in solid lines in FIG. 1. However, if an impact load is applied to dumbbell 2, arms 12 of carrier 14 can deflect to the side as shown in phantom lines in FIG. 1. After the impact load passes, arms 12 in carriers 14 will restore themselves to their normal orientation. Thus, according to the earlier definition herein of the term shock absorbing system, the flexible arms of carriers 14 comprise the shock absorbing system.

While only one carrier 14 holding one weight plate 6 is shown in FIG. 1 as having deflected, such deflection would typically occur on at least some other carriers 14 close to the impact load. The deflection of the other carriers 14 is not shown in FIG. 1 simply for the purpose of clarity in the drawings.

Figure 2:
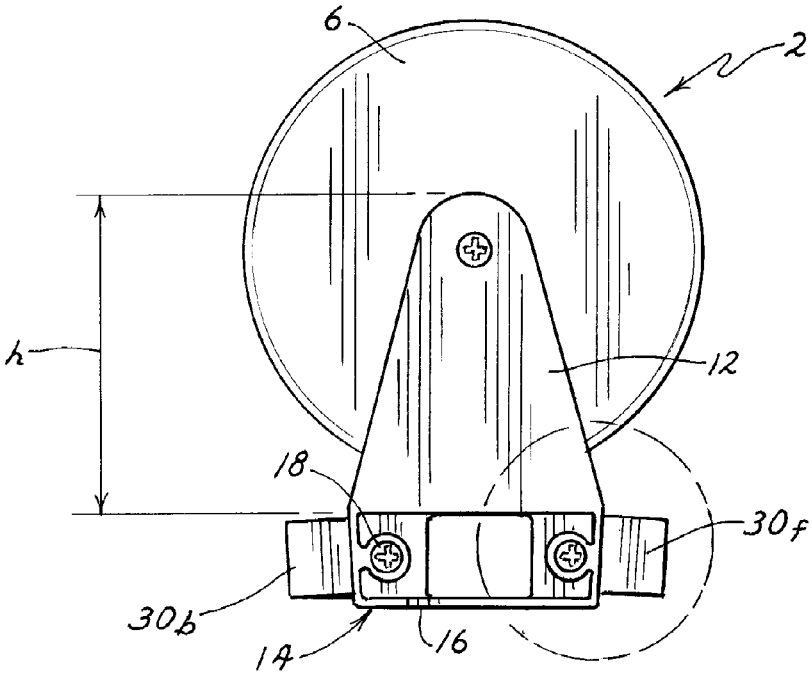
FIG. 2 is a side elevational view of the selectorized dumbbell of FIG. 1.

Arms 12 of each carrier need to be stiff enough to support weight plate 6 in its normal, substantially upright orientation. At the same time, arms 12 need to be flexible enough to bend or flex if dumbbell 2 experiences an impact load, such as might occur if dumbbell 2 bangs against a fixed object or is dropped. The Applicants have found that a carrier 14 made of ultra high molecular weight polyethylene (UHMW-PE) plastic works well. Such UHMW-PE material is sold under trade names such as TUFLAR® manufactured by Keltrol Enterprises, Inc. of York, Pa. or TIVAR® manufactured by Poly Hi Solidur of Fort Wayne, Ind. A carrier 14 with arms that are 4" high, as indicated at h in FIG. 2, and that are between 0.062" and 0.125" thick, as indicated at t in FIG. 3, have the appropriate mixture of stiffness and flexibility for properly supporting a 5 lb. weight plate.

Obviously, the materials used to form arms 12 can be varied. In addition, the shape, height and thickness of arms 12 can also be varied for supporting lighter or heavier weight plates. Since arms 12 are made of a plastic material that is somewhat naturally slick, and since arms 12 are relatively narrow and small compared to the much larger weight plate 6, it is easier to slide one weight 4 up out of a stack or down into a stack. Arms 12 engage and slide over one another much more easily than weight plates 6 would slide over one another if weight plates 6 simply nested directly against one another.

Thus, the separation between weight plates 6 provided by arms 12 of carriers 14 is advantageous.

Carriers 14 are made in two halves $\mathbf{14}_a$ and $\mathbf{14}_b$ as indicated in FIGS. 1 and 3 by the parting line 15 between halves $\mathbf{14}_a$, $\mathbf{14}_b$. Each carrier half $\mathbf{14}_a$ and $\mathbf{14}_b$ carries one of the flexible arms 12 in each pair of arms 12. Carrier halves $\mathbf{14}_a$, $\mathbf{14}_b$ are secured together by a plurality of attachment bolts 18 and nuts 20 shown in FIG. 3. When secured together, bolts 18 and nuts 20 are recessed within the left and right sides of base 16 of carrier 14 so that they do not project laterally outwardly beyond the left and right sides of base 16 of carrier 14. Carrier halves $\mathbf{14}_a$, $\mathbf{14}_b$ are also formed so as to provide a slot 22 in each of the front and back sides of base 16 of carrier 14 along parting line 15 between carrier halves $\mathbf{14}_a$, $\mathbf{14}_b$. Each carrier 14 extends perpendicularly relative to the axis of handle 8.

The upper ends of arms 12 of carrier 14 each have an inwardly protruding cylindrical stub shaft 24 for mounting weight plate 6 between arms 12. Stub shafts 24 on the pair of arms 12 protrude partly into a central mounting hole 5 provided in each weight plate 6 from either side of hole 5. Another attachment bolt 26 and nut 28 are provided to secure the upper ends of arms 12 together. When this occurs, stub shafts 24 abut one another to form, in effect, a cylindrical hub. This also holds weight plate 6 between arms 12 with hole 5 of weight plate 6 being concentrically received on the hub formed by stub shafts 24 on arms 12 of carrier 14. Again, the head of attachment bolt 26 and nut 28 are seated in recesses in arms 12 so that the attachment bolt and nut do not protrude beyond the outer faces of arms 12.

Each nested weight 4 preferably comprises a pair of carriers 14 and a pair of weight plates 6, namely a first carrier 14 carrying left weight plate $\mathbf{6}_l$ and a second carrier 14 carrying right weight plate $\mathbf{6}_r$. Weight plates 6 comprising each weight 4 are laterally spaced apart from one another. A pair of interconnecting members comprising a front rail $\mathbf{30}_f$ and a back rail $\mathbf{30}_b$ unite or join the laterally spaced apart weight plates 6 together. The front and back rails 30 used in different weights 4 have progressively increasing lengths as one proceeds from the inner to the outer weights 4 in each stack. This progressively increases the spacing between the left and right weight plates $\mathbf{6}_l$ and $\mathbf{6}_r$ in each weight 4 to allow the different weights 4 to be nested together. Rails 30 comprise strap like steel rails having a substantially flat cross-sectional profile.

Opposite ends of rails 30 are easily bent into an L-shape to provide inturned ends 34. Ends 34 are received in slots 22 formed along the parting lines 15 between carrier halves $\mathbf{14}_a$, $\mathbf{14}_b$. Each inturned end 34 includes an opening 36 for allowing one of the attachment bolts 28 that secure carrier halves $\mathbf{14}_a$, $\mathbf{14}_b$ together to pass through the end 34 of rail 30. Like the lengths of rails 30, inturned ends 34 of rails 30 progressively increase in depth from rails 30 used on the inner to the outer weights 6 in each stack. This allows rails 30 of the different weights 4 to nest inside one another as shown in FIG. 5.

Figure 4:
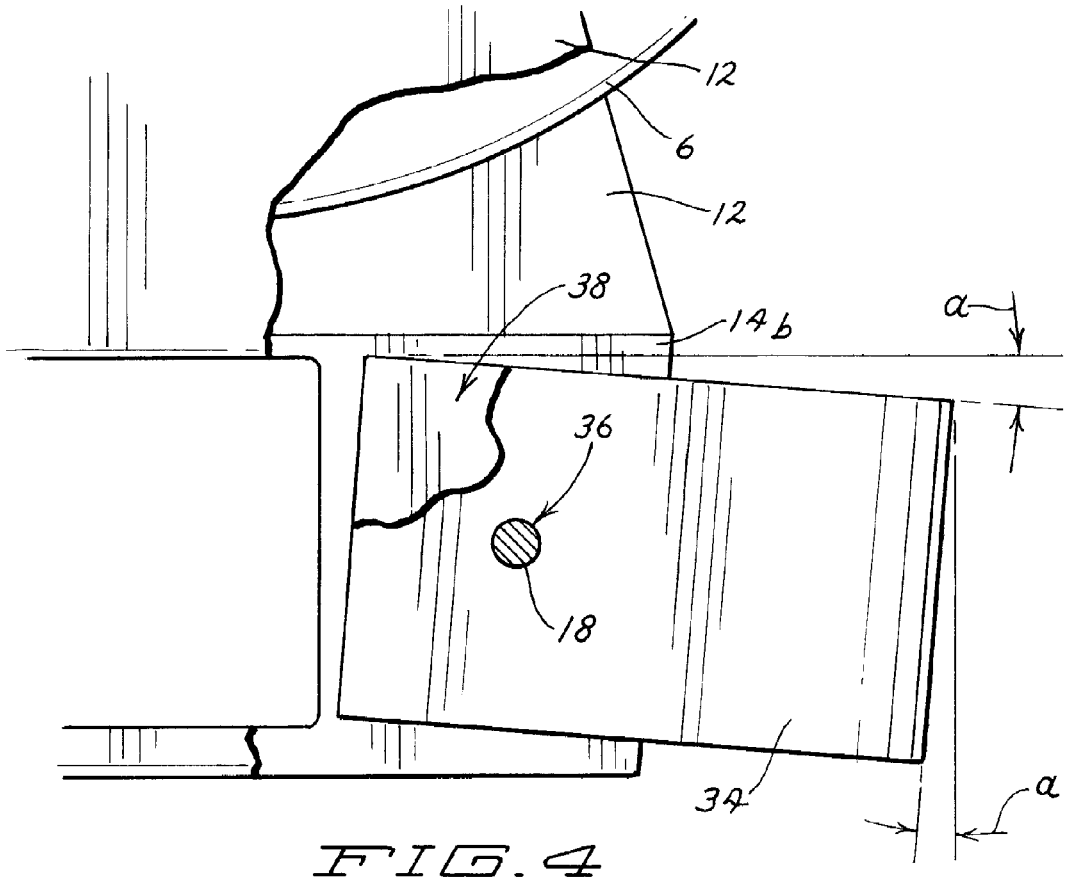
FIG. 4 is an enlarged, partially broken away, side elevational view of the circled portion of FIG. 2, particularly illustrating the attachment of one of the connecting rails to the base of the carrier.

Referring to FIG. 4, inturned ends 34 of rails 30 are each received in a molded pocket 38 in each carrier half $\mathbf{14}_a$ or $\mathbf{14}_b$. Pocket 38 in carrier half $\mathbf{14}_a$ forms one half of slot 22 and an identical pocket 38 in carrier half $\mathbf{14}_b$ forms the other half of slot 22. Pocket 38 is angled slightly downwardly relative to a horizontal line as indicated by the angle $\alpha$ in FIG. 4. This positions the main body of rail 30, namely the long section of rail 30 extending between inturned ends 34, at a corresponding angled inclination extending from top to bottom. In other words, the top of rail 30 is angled outwardly relative to the bottom of rail 30 by the same angle $\alpha$, also as shown in FIG. 4. Preferably, $\alpha$ is quite small, approximately 3° or so.

In addition, arms 12 of carriers 14 are molded to base 16 in such a way that arms 12 of carriers 14 also angle outwardly towards the outer side of dumbbell 2 as they extend upwardly. In other words, when carrier halves $\mathbf{14}_a$, $\mathbf{14}_b$ are bolted together on inturned ends 34 of the front and back rails 30, arms 12 of carriers 14 used to hold the left weight plates $\mathbf{6}_l$ will angle outwardly towards the left and arms 12 of carriers 14 used to hold the right weight plates $\mathbf{6}_r$ will angle outwardly towards the right. This is shown by the angle $\beta$ in FIG. 1. The angle $\beta$ is also approximately 3°.

The angles $\alpha$ and $\beta$ permit weights 4 to separate from or nest down inside one another more easily when handle 8 is lifted out of or lowered down into the gap between the stacks of weight plates 6. The outward inclination of the main bodies of rails 30 provided by the angle $\alpha$ serves to guide rails 30 together when those weights 4 carried on handle 8 are dropped down into the other weights 4 remaining on a rack (not shown). FIG. 5 shows how the main bodies of rails 30 nest inside one another when weights 4 are nested together. Similarly, the outward inclination of weight plates 6 provided by the angle $\beta$ serves a similar function in allowing weight plates 6 to be more easily separated from one another or nested back together.

The angles $\alpha$ and $\beta$ are not new to this invention but can be found in prior art selectorized dumbbells manufactured by the assignee of this invention. However, the angles $\alpha$ and $\beta$ are easily and inexpensively provided in carrier 14 in the molding process. For example, the angle $\alpha$ is provided simply by inclining the molded pockets 38 in carrier halves $\mathbf{14}_a$, $\mathbf{14}_b$ downwardly at the desired angle $\alpha$. Similarly, the angle $\beta$ is provided by molding arms 12 at a slight angle relative to base 16 of carrier 14.

Each weight 4 has a weight selection section, shown generally as 40 in FIG. 1, which coacts with selector 10 to determine which weights 4 are picked up by handle 8 and which are not. The nature of weight selection section 40 varies with the nature of selector 10. When selector 10 comprises an insertable pin, weight selection section 40 can comprise various unique sets of holes and slots provided in rails 30 that will pick up different numbers of weights 4 depending upon which set of holes and slots is used to receive the pin. See U.S. Pat. No. 5,769,762. However, the specific selector and the specific nature of weight selection section 40 of weights 4 can vary and do not form part of this invention.

Essentially, in each weight 4, the rigid bases 16 of each carrier 14 are rigidly secured to steel rails 30. Together, carriers 14 and rails 30 form a weight frame for holding a plurality of weight plates 6. A part of this weight frame is rigid, namely the part comprised of the rigid bases 16 of carriers 14 and the rigid rails 30 to which bases 16 are bolted. Another part of this weight frame is flexible, namely the part comprising the various flexible arms 12 of carriers 14.

Users can and often do drop either an individual weight 4 or an entire selectorized dumbbell 2 loaded with a number of weights 4 onto the floor. With dumbbell 2 of this invention, the shock absorbing system incorporated into weights 4 will absorb many of these impact shocks by causing arms 12 of carriers 14 to deflect. Arms 12 of carriers 14 will reset or restore themselves after the impact shock is over, often without damaging any portion of dumbbell 2. At the very least, the shock absorbing system of this invention greatly minimizes both the chances for damage to occur as well as the degree of damage should any damage occur at all.

In addition, if some damage occurs to weights 4 of dumbbell 2 despite the presence of the shock absorbing system formed by flexible arms 12 of carriers 14, such damage often takes the form of bent rails 30. With weights 4 of dumbbell 2 of this invention, it is easy to disassemble any particular weight 4 simply by unscrewing carrier halves $\mathbf{14}_a$, $\mathbf{14}_b$ of each carrier to free rails 30. Rails 30 can then be removed and replaced. Alternatively, if rail 30 is just bent, it would also be possible to use a hammer and a vise to simply straighten out any unwanted bends in rail 30. Once rail 30 is straightened, it can be easily replaced between carrier halves $\mathbf{14}_a$, $\mathbf{14}_b$ and carrier halves $\mathbf{14}_a$, $\mathbf{14}_b$ can be secured together once again to grip inturned ends 34 of rails 30 between them.

As a result of all of the above, dumbbell 2 of this invention will be less prone to being damaged than prior art selectorized dumbbells. This will increase user satisfaction by decreasing the times when the user is not able to use selectorized dumbbell 2 because it has been damaged. In addition, warranty costs to the manufacturer will be decreased, thus increasing the manufacturer's profit margins. The manufacturer will also enjoy the increased goodwill that will come from having a more reliable product in operation.

Flexible arms 12 of carriers 14 comprise only one shock absorbing system that could be used. Instead, arms 12 could be rigid like base 16, but could then be connected to base 16 by a live hinge that functions as the shock absorbing system. Alternatively, a pair of rigid arms 12 could be pivotally attached to base 16 by a pivot pin for side-to-side pivoting and a plurality of springs could be used to center arms 12 on base 16 and to oppose the pivoting motion of arms 12.

Moreover, as mentioned earlier, the location of the shock absorbing system is not confined to carriers 14 used to carry weight plates 6 or to the type of selectorized dumbbell 2 as shown herein.

For example, as shown in FIG. 4 of the 762 patent incorporated by reference above, dumbbell 2 could be of the type in which the spaced left and right weight plates of each weight are connected together by a pair of rails, namely a front and back side rail. The rails are metallic and are welded at their ends to the front and back sides of the left and right weight plates. Moreover, the rails for different weights are at different elevations and overlie one another in a vertically spread apart array.

In this type of dumbbell 2, the selector comprises a double pronged connecting pin. The connecting pin is selectively inserted beneath the rails for any particular weight in the set of nested weights. This is done by sliding the two prongs of the connecting pin into two slots in a set of vertically spaced slots carried on each vertical end of the handle. Each prong slides into the slot on one end of the handle so that the prongs pass beneath the rails of the selected weight. Then, when the user picks up the handle, the handle carries with it the weight having the rails that are engaged by the prongs of the connecting pin as well as all the weights whose rails lie above the rails of the selected weight.

To incorporate a shock absorbing system in this type of dumbbell 2, the shelves that form the slots on each end of the handle could simply be molded of a resilient material. This material could be rubber or some other resilient elastomeric or plastic material. The resilient material would be stiff enough to not deform under normal use of dumbbell 2, but would deform and absorb shock if dumbbell 2 were dropped. In such a dumbbell, the use of a handle having fully or partially resilient ends would prevent damage to the prongs of the connecting pin which are normally made of a metallic material such as stainless steel.

Or, in such a dumbbell 2, handle 8 could have rigid ends with rigid prong receiving slots as is normally the case. Instead, selector 10 could be manufactured at least partially of a shock absorbing material, such as the UHMW-PE described above. For example, each prong of the connecting pin or the entire connecting pin including both prongs could be molded out of UHMW-PE. In this event, the prongs of the connecting pin would bend and then restore themselves if an impact load is felt by dumbbell 2.

Various other modifications of this invention will be apparent to those skilled in the art. Thus, the scope of this invention is to be limited only by the appended claims.

We claim:

1. A selectorized dumbbell, which comprises:

(a) a plurality of nested weights, a handle, and a selector that couples a selected number of the weights to the handle; and (b) wherein each nested weight comprises:

(i) at least one rigid weight plate; and (ii) a weight frame with rigid and flexible portions, wherein the flexible portion of each weight frame comprises a substantially planar flexible arm that bends or flexes at a location adjacent one end of the arm, wherein the weight plate is immovably attached to and carried by an opposite free end of the flexible arm of the weight frame such that the flexible arm substantially alone bears and supports the weight of the weight plate and the flexible arm and the weight plate jointly move together as one unit to permit the weight plate to move relative to the rigid portion of the weight frame in response to an impact shock by flexing of the flexible arm relative to the rigid portion of the weight frame.

2. The dumbbell of claim 1, wherein the rigid portion of each weight frame includes a weight selection section that coacts with the selector to determine whether or not the weight frame is coupled to the handle.

3. The dumbbell of claim 1, wherein each nested weight further comprises at least a pair of flexible arms that are spaced apart from one another on opposite ends of the rigid portion of the weight frame, and wherein at least one weight plate is immovably attached to each flexible arm on each end of the rigid portion of the weight frame.

4. A selectorized dumbbell, which comprises:

(a) a stack of nested left weight plates separated by a gap from a stack of nested right weight plates, (b) a handle that can be inserted into the gap between the weight plate stacks;

(c) a selector that determines how many left weight plates are coupled to a left end of the handle and how many right weight plates are coupled to a right end of the handle; and (d) wherein each weight plate is carried on at least one flexible member in a manner such that the at least one flexible member substantially alone bears and supports the weight of the weight plate, wherein the at least one flexible member that carries each weight plate is separate and distinct from the flexible members used to carry the other weight plates, and wherein the flexible members are configured to allow the weight plates to deflect out of a normal orientation if an impact shock is delivered to the dumbbell and to subsequently restore the weight plates to their normal orientation once the impact shock dissipates.

5. A selectorized dumbbell, which comprises:

(a) a plurality of nested weights, a handle, and a selector that couples a selected number of weights to the handle; and (b) wherein each nested weight comprises:

(i) a forked carrier having a pair of spaced arms extending upwardly from an underlying base;

(ii) a weight plate that is formed as a separate piece from the arms and base of the forked carrier, wherein the weight plate is removably held between the arms of the carrier with the weight plate being supported by the arms on the base of the carrier in a manner such that the weight plate is spaced above and substantially out of direct contact with the base of the carrier with the weight of the weight plate being borne by the arms of the carrier; and (iii) wherein the arms of the carrier are flexible to permit the weight plate to flex out of a normal orientation and to return to the normal orientation to thereby absorb impact shocks.

6. The dumbbell of claim 5, further including a horizontal hub extending between the arms of the carrier, wherein the weight plate has a hole that is concentrically received on the hub to secure the weight plate to the carrier.

7. The dumbbell of claim 6, wherein each of the arms of the carrier includes a stub shaft that forms a portion of the horizontal hub with the stub shafts entering the hole in the weight plate from opposite sides of the hole.

8. The dumbbell of claim 6, further including a fastener passing through the horizontal hub of the carrier for holding the arms of the carrier together to secure the weight plate therebetween.

9. The dumbbell of claim 5, wherein each weight includes a left carrier holding a left weight plate and a right carrier holding a right weight plate, wherein the left and right carriers are spaced apart from one another and are secured, respectively, to the left and right ends of at least one interconnecting member that joins the left and right carriers together.

10. The dumbbell of claim 9, wherein the left and right ends of the interconnecting member are releasably received in slots in the bases of the left and right carriers.

11. The dumbbell of claim 9, wherein the bases of the carriers and the interconnecting member form a substantially rigid weight frame, and wherein the arms of the carriers are flexible relative to the rigid weight frame.

12. A selectorized dumbbell, which comprises:

(a) a plurality of nested weights, a handle, and a selector that couples a selected number of the weights to the handle; and (b) wherein each nested weight comprises:

(i) a pair of weight plates;

(ii) a weight frame for carrying the weight plates in a spaced apart orientation, wherein the weight frame comprises:

a pair of carriers, wherein each carrier has a base and at least one arm projecting upwardly from the base with the weight plate being secured to the arm such that each carrier holds one weight plate, and wherein the base of each carrier is made in two halves that abut one another along a parting line with the two halves being releasably secured together along the parting line;

a pair of elongated interconnecting members extending between and releasably connected to opposite front and back sides of the bases of the pair of carriers to join the carriers together and hold the carriers in the spaced apart orientation, wherein each interconnecting member has opposite ends that are L-shaped with each L-shaped end of the interconnecting member being inserted between the carrier halves into a slot formed along the parting line; and wherein each interconnecting member comprises a strap having a substantially flat cross-sectional profile, and wherein the slot into which each L-shaped end of each strap is inserted is angled upwardly as one proceeds inwardly along the slot such that the strap between the L-shaped ends is angled outwardly as one proceeds upwardly.

* * * * *